US006648725B2

(12) United States Patent
Chan

(10) Patent No.: US 6,648,725 B2
(45) Date of Patent: Nov. 18, 2003

(54) INTERACTIVE TOY TEAPOT

(75) Inventor: Albert Wai Tai Chan, Taipei (TW)

(73) Assignee: Thinking Technology, Inc., Nassau (BS)

( * ) Notice: Subject to any disclaimer, the term of this patent is extended or adjusted under 35 U.S.C. 154(b) by 0 days.

(21) Appl. No.: 10/033,887

(22) Filed: Jan. 3, 2002

(65) Prior Publication Data

US 2002/0086612 A1 Jul. 4, 2002

Related U.S. Application Data

(60) Provisional application No. 60/259,221, filed on Jan. 3, 2001.

(51) Int. Cl.[7] ..... A63H 3/52
(52) U.S. Cl. ..... 446/479; 446/175
(58) Field of Search ..... 446/479, 484, 446/175, 268, 297, 267, 481; 126/388.1

(56) References Cited

U.S. PATENT DOCUMENTS 3,046,683 A * 7/1962 Buh, Jr. et al.
3,226,528 A * 12/1965 Martin
3,774,338 A * 11/1973 Waak ..... 46/14
4,735,191 A * 4/1988 Boursse et al. ..... 126/388
4,768,989 A * 9/1988 Moomaw ..... 446/193
5,314,336 A 5/1994 Diamond et al.
5,344,034 A * 9/1994 Eagan ..... 215/11.1
5,441,039 A * 8/1995 Yeh ..... 126/388
5,451,178 A * 9/1995 Yorozu et al. ..... 446/175
5,536,196 A * 7/1996 Sternberg ..... 446/81

FOREIGN PATENT DOCUMENTS

WO WO 90/15402 12/1990
WO WO 00/44461 8/2000

* cited by examiner

*Primary Examiner*—Jacob K. Ackun
*Assistant Examiner*—Jamila Williams
(74) *Attorney, Agent, or Firm*—Kramer & Amado, P.C.; Gordon J. Zimmerman

(57) ABSTRACT

A toy comprises: a first part and a second part, the parts being adapted to be placed into registration, the first part comprising short-range sensor means, the second part comprising one or more reflective areas adapted to be sensed and/or one or more non-reflective areas adapted not to be detected by the sensor means, such that when the second part is placed into registration with the first part, a sensor signal is generated specific to the area or areas sensed; and processing means in the first part adapted to receive said signal and to general an appropriate response. In a particular embodiment, an electronic toy teapot comprises a pot and a plurality of lids, each lid corresponding to a particular character or personality, sensor means in the pot adapted to detect which of said lids is located on the pot at anytime, processing means to receive a signal from the sensor means and to generate an appropriate response corresponding to the particular lid located on the pot, and communication means to express said response audibly or visually.

16 Claims, 6 Drawing Sheets

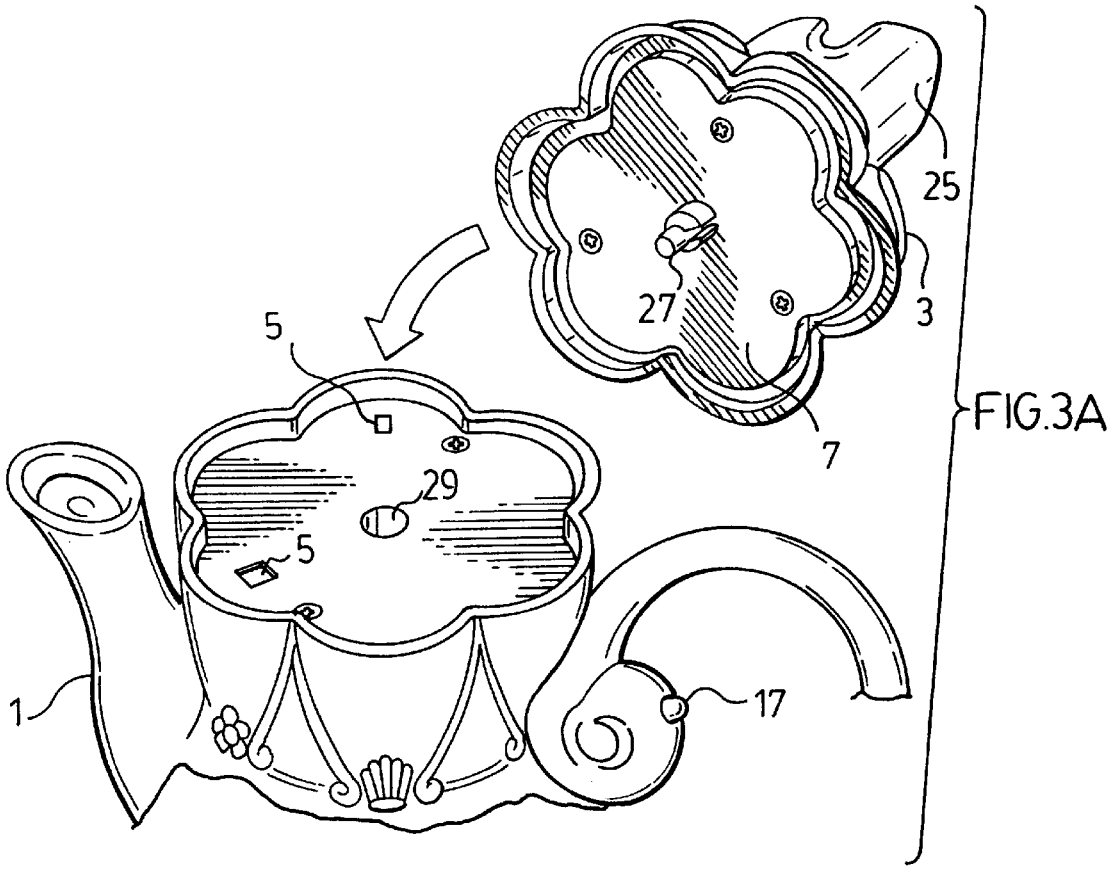
FIG.3A
FIG. 3B.
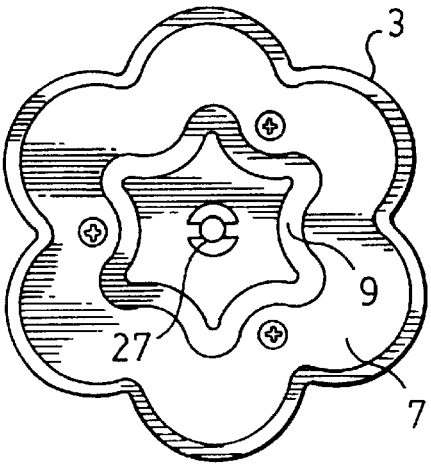
FIG. 3C.
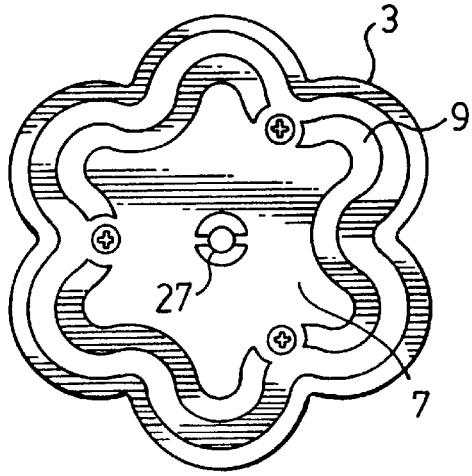

INTERACTIVE TOY TEAPOT

This application claims the benefit of a Provisional Application No. 60/259,221 filed Jan. 3, 2001.

Children have played with toy teapots and cups for many years. The experience provides an opportunity to pretend to conduct a social event, the serving of tea, in circumstances limited only by the child's imagination. In order to contribute to the child's enjoyment of the tea ceremony, however, it would be an advantage to have the teapot act in a non-passive manner. In other words, if the teapot could talk or make pouring sounds, for example, the enjoyment in using the teapot would be greatly increased. If the toy could interact, or appear to interact with the child, the enjoyment would be magnified. Certain of the principles of an invention comprising these advantages could be applied to toys other than teapots.

SUMMARY OF THE INVENTION

Accordingly, in an aspect of the invention, a toy comprises a first part and a second part, the parts are adapted to be placed into registration, the first part comprises short range sensor means, the second part comprises one or more reflective areas adapted to be sensed and/or one or more non-reflective areas adapted not to be sensed by the sensor means, such that when the second part is placed into registration with the first part, a sensor signal is generated specific to the area or areas sensed, and processing means in the first part are adapted to receive the signal to generate an appropriate response.

In a further aspect, the toy further comprises a multiplicity of second parts coded by reflective and non-reflective areas to be individually recognized by the first part when placed into registration.

In further aspects of the invention:

(a) the sensor means comprises multiple short-range sensors;

(b) each sensor comprises a generator of electromagnetic energy and a detector of such energy mounted as a pair;

(c) reflective areas comprise surfaces adapted to lie within the range of the sensor, and non-reflective areas comprise recessed surfaces adapted to lie outside the range of the sensor when the first part and second part are placed into registration.

In a further aspect, an electronic toy teapot comprises a pot and multiple lids, each lid corresponding to a particular character or personality, sensor means in the teapot adapted to detect which of said lids is located on the pot at any time, processing means to receive a signal from the sensor means and to generate an appropriate response corresponding to the particular lid located on the pot, and communication means to express said response audibly or visually.

In a further aspect, the audible or visual response comprises one or more of voice effects, sound effects, and music.

In further aspects of the invention, the electronic toy teapot further comprises:

(a) a microphone acting with said processing means to receive an audible signal from a user of the teapot, and to generate the audible or visual response within a suitable delay thereafter;

(b) an indicator light to indicate to the user that an audible signal is desired or anticipated;

(c) status switch means adapted to change between open and closed conditions as the teapot is lifted in readiness for simulated pouring, or set down after pouring;

(d) tilt switch means adapted to initiate the sound of pouring tea when the teapot is tilted to lower the spout, and to end said tea pouring sound when the teapot is returned to a substantially upright position;

(e) trigger means to initiate delivery of electrical power from a battery power source to the electronic components of the teapot;

(f) said trigger means being located on each lid;

(g) said trigger means comprising a protrusion on each lid adapted to trigger a trigger switch located on or in the pot.

BRIEF DESCRIPTION OF THE DRAWINGS

An illustrative embodiment of the invention is shown in the attached drawings, in which:

FIG. 3A is an exploded view of a pot and lid;

FIGS. 3B and 3C are underside views of alternative embodiments of teapot lids;

DETAILED DESCRIPTION OF THE INVENTION

Figure 1:
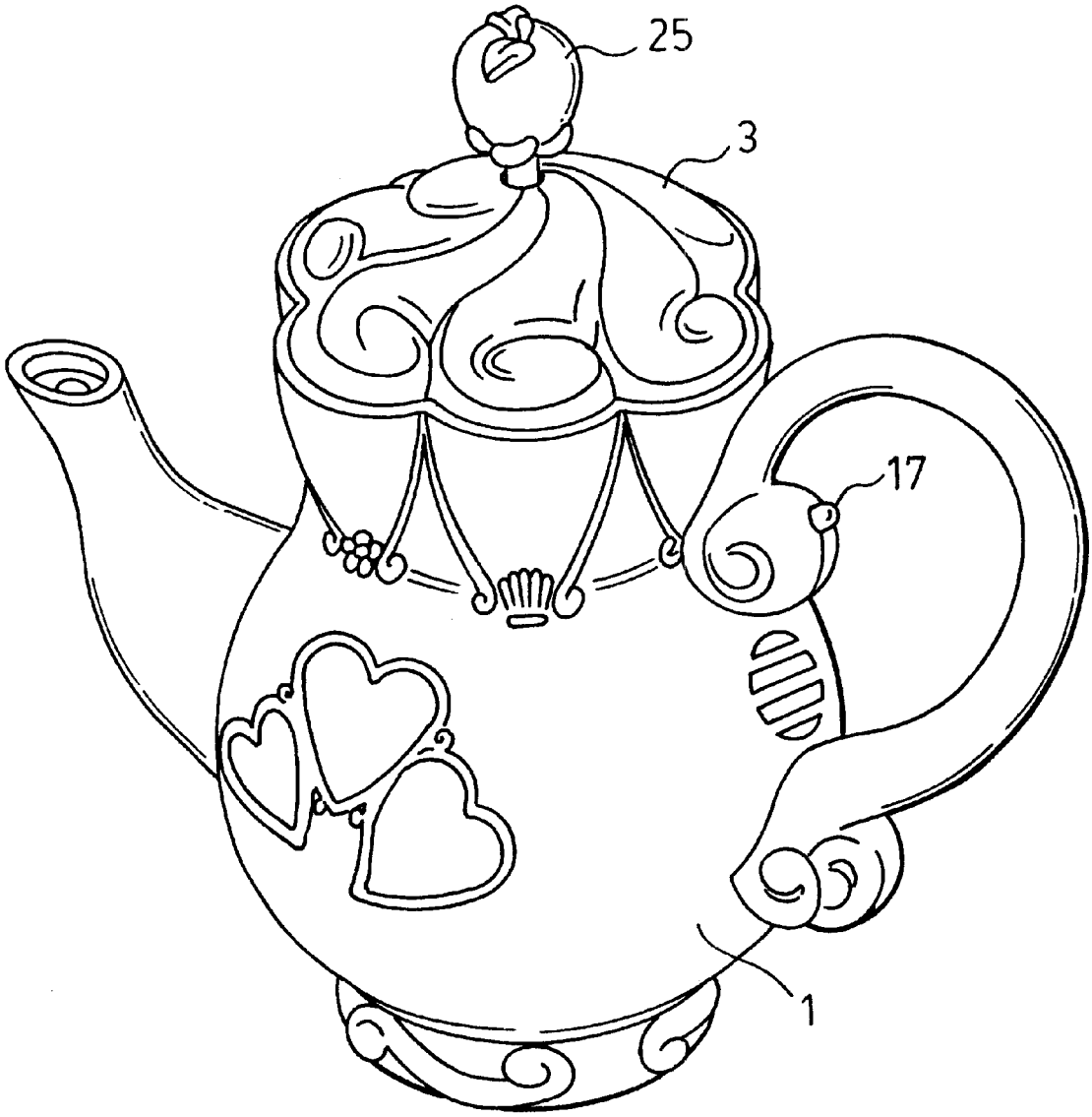
FIG. 1 is a perspective view of the exterior of an assembled teapot.

Although a teapot is illustrated as the preferred embodiment of this invention, the invention may be applicable to other toys of similar construction. The teapot comprises a pot portion and a lid portion. The upwards facing surface of the pot portion contains one or more sensors adapted to detect the presence or absence of a lid, and in particular, the specific lid which maybe chosen from a multiplicity of lids. The sensors may be of any suitable type, but short range infrared sensors have proven to be very effective for this purpose.

Since this is an electronic toy, it requires a source of electrical energy. This could be provided by means of a connection to a wall outlet, although use of self-contained electrical storage batteries is typically much more appropriate for children. Batteries provide the advantages of being completely portable with the toy, and providing an electrical current and voltage which is safe for use by children. The particular type of battery power used can be chosen from suitable options, as known within the toy industry.

The sensors in the teapot may comprise pairs of emitters and detectors of energy, typically electromagnetic energy. For example, a source of infrared energy can direct a beam of such energy at an angle such that a reflective surface placed within a certain range of distance from the detector will generate a reflected signal to the detector. If a flat surface is made nonreflective to infrared radiation, no signal will be generated by the sensor. Non-reflectivity can be created by choice of colour, material and texture. Reflectivity will depend upon the power of the energy source, its wave length, the angle of reflection from the source to the detector, and other factors.

By the same token, before the lid is placed on the teapot, no signal will be generated by the sensor since no reflective surface is in range of the sensor. Using this principle, reflective and non-reflective areas of the lid can also be created by selected topography of the underside of the lid. Portions of the underside of the lid which are in relief will be close enough to generate a sensor signal, while portions of the lid which are recessed will be too far away to generate such a signal. Thus, the pattern of raised and recessed areas of the underside of the lid provides a very effective means to code the lids for recognition by the pot.

In this way, a series of lids, each with differently coded lower faces, can represent different characters or personalities; as each lid is replaced by a new one, the teapot can take on a different personality or represent a different character. The topography of each lid can be created in such a way as to be aesthetically pleasing. For example, a pattern on the underside of each lid maybe representative of the particular character and will seem to be recognized by the teapot owing to that aesthetic appearance, whereas, in reality, the recognition is due to the presence or absence of reflective surfaces close enough to the detector to generate a sensor signal. The coding pattern can be anything suitable to create a particular set of reflective and non-reflective areas adjacent the sensors.

Sensors require electrical energy in order to scan for a surface, and this is typically provided by electrical storage batteries as described above. In order to preserve battery life, and to provide an added step for initiation of activity by the child, a trigger switch can be located on the upward facing surface of the pot. This switch may be triggered when the lid is placed in close enough registration with the pot so that sensing can begin. In the alternative, a protrusion on the lid which fits into an opening or receptacle containing the trigger switch on the pot can be provided. In this way, when the lid is pressed against the pot, it can be mechanically held in place by a press fit between the protrusion and the receptacle while at the same time triggering the trigger switch. The trigger switch, when closed by the placement of the lid on the pot, allows electrical energy to begin flowing to the sensors. When the lid is removed, the trigger switch again is opened which breaks the flow of electrical energy to the sensors, or at least initiates a sequence controlled by some processing means to eventually shut down power to the sensors and other components of the toy. Integrated circuits present in the toy to control other functions may be used for this purpose, or dedicated integrated circuits may be employed.

As an added feature, the trigger switch may be triggered only when the protrusion on the lid is forced into the receptacle on the pot such as by the pressing of a button on the top of the lid by the child playing with the toy. Thus, the mere placement of a lid on the pot will not cause battery power to flow; the user will have to take an active step to generate a response from the toy. Again, such a feature saves battery power.

The teapot, or other toy of similar design, can also be interactive with the child. The teapot can be provided with a microphone which will sense sound, like human speech, generated by the child using the toy. The teapot is provided with a microprocessor which recognizes the particular lid placed on the teapot and is pre-programmed to generate a set of responses appropriate to the lid chosen. The processor then sends a signal to some communication means, which may include sound generation means like an audio speaker, or visual communication means, such as lights or a display screen, to communicate with the child. For example, by means of a question generated by the communication means, the child may be asked whether it is time to begin pouring tea.

The teapot may additionally be provided with some sort of indicator to indicate to the child that a response is requested or anticipated. Such an indicator could be a flashing LED light, for example. When the volume of the child's speech drops to a certain level typically corresponding to the end of a sentence, or a significant pause occurs, a microphone in the teapot receiving the voice signal from the child and passing it on to a microprocessor will indicate that it is time for the teapot to again respond to the child. At this point, the indicator may change condition so that the child will not expect to be able to communicate further with the teapot until a certain action is completed.

One of the main actions which a teapot can perform is the pouring of tea. The teapot may be provided with a status switch which is spring-loaded at the bottom of the teapot. When the teapot is placed on a flat surface, the spring will be compressed and the switch will be open (or closed at the option of the designer). When the teapot is lifted, the spring will relax and the switch will be closed (or alternatively open in the alternative design). This change in status will be received by the microprocessor and appropriate signals will be generated indicating that the tea is ready to be poured when the teapot is placed on the surface, or that pouring is occurring or imminent when the teapot is lifted off the surface.

The simulation of pouring tea can also be incorporated in this invention. The teapot comprises at least one tilt switch which is sensitive to tilting of the teapot from its normal upright sitting position to a position where the spout is lowered into a tea pouring position, and returned to a substantially upright position where pouring would not occur. Such tilt switches can comprise a mercury type switch, or some other switch such as an electrically conductive ball which rolls within a tube when tilting occurs in order to make an electrical connection at the end of such a tube. When the teapot is tilted back to the upright position, the electrical connection is broken. When the electrical connection is made, the microprocessor generates a signal which the sound generation means reproduces as the sound of pouring tea. In addition, a timer can be provided so that when the teapot is kept in the tilted, pouring position for a long enough period of time, the sound generated corresponds to the teapot running dry. When the teapot is returned to its upright position, the pre-programmed pouring sound can return to its initial state such that pouring can recommence.

A manual switch can be provided as a master control for electrical power. The switch may be placed in the off position, when no power will flow, in the on position when power will flow except when interrupted by other means in the teapot as previously discussed, or in an intermediate position for in-store use when the teapot will generate sound in response to the pressing of a button mounted on the teapot, without routing of power to the sensors. In this way, battery power can be preserved while the toy is being tested in-store. The same button can be used to generate responses from the teapot at will during normal use after purchase.

In addition, in order to preserve battery power, the processing means can be provided with a timer. When no activity occurs for a specified period of time, the toy will go into a "sleep" mode, with minimal battery power use. The toy can be taken out of sleep mode by, for example, a voice input from the child sensed by the microphone, the lifting of the teapot with a resultant change in the status switch, or the placement of a lid on the pot. The pot can be programmed to request that an appropriate lid be placed on the pot in order that play activity can begin.

Figure 2:
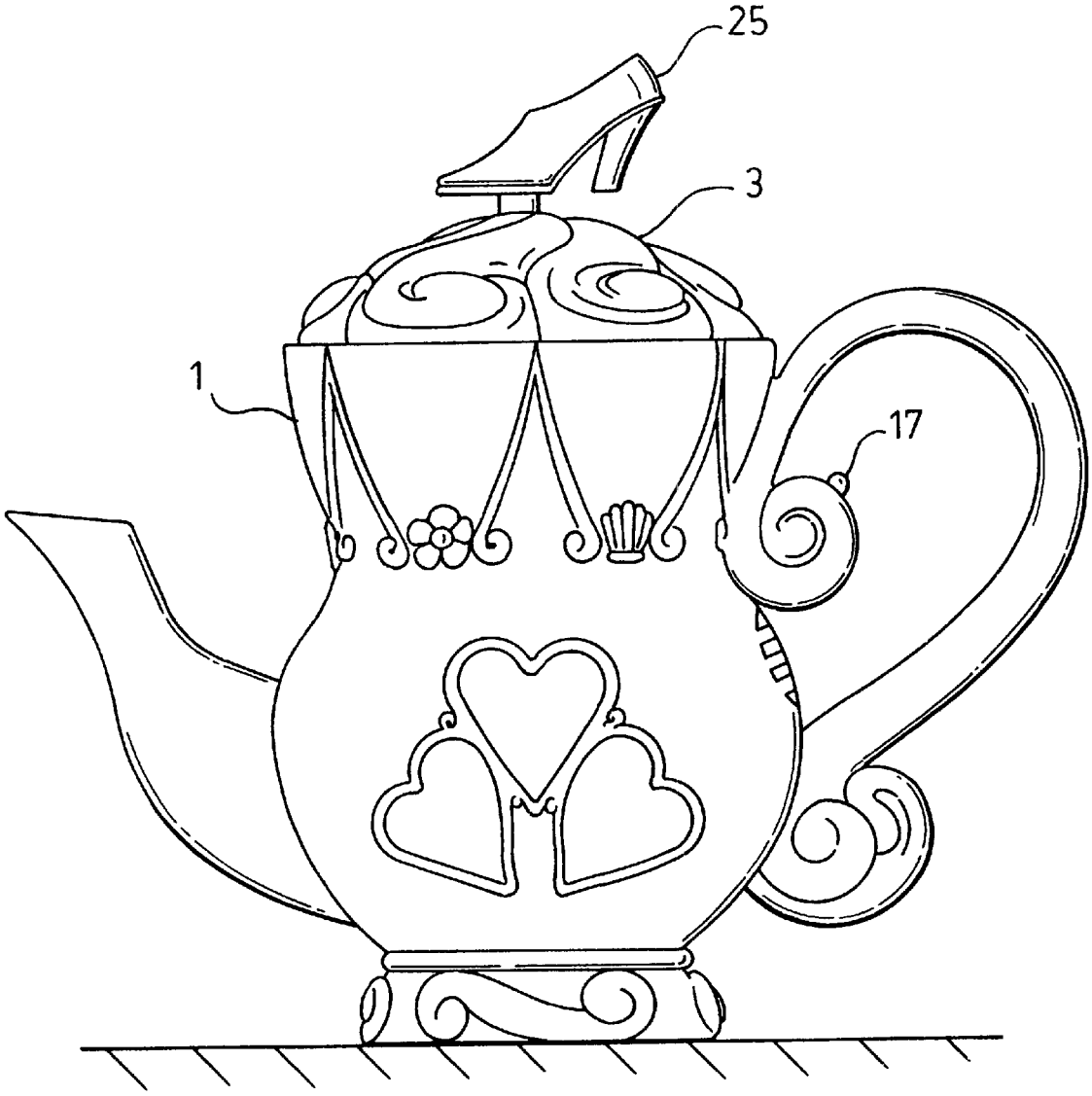
FIG. 2 is a side elevation view of an assembled teapot.

Turning to the drawings, FIG. 1 illustrates an assembled teapot prior to activation of functions. Pot 1 is resting on a flat surface with lid 3 in place. Trigger means 25 are not deployed. Indicator light 17 is dark given that the flow of battery power to the electrical components has not yet been triggered. FIG. 2 is an elevation view of a teapot 1 with a different lid 3 identified to the user by a differently shaped trigger means 25. The different shapes of the trigger means are employed by the user to identify the particular character or personality to be generated when the teapot is placed into operation. FIG. 3A illustrates a lid 3 being moved into place to register with pot 1. The shape of the lid dictates how it will fit onto pot 1. Photosensors 5 are adapted to emit and receive electromagnetic radiation, typically infrared. Reflective areas 7 on the underside of lid 3 will cause a signal to be received by one or more of sensors 5. In FIG. 3A, the underside of the lid 3 comprises only reflective areas 7. Alternatively, FIGS. 3B and 3C illustrate different patterns of reflective areas 7 and non-reflective areas 9. The non-reflective areas may be differently coloured or, in this case, recessed areas which will not reflect a signal to the very short range sensors 5. Protrusion 27 fits into orifice 29.

Figure 4:
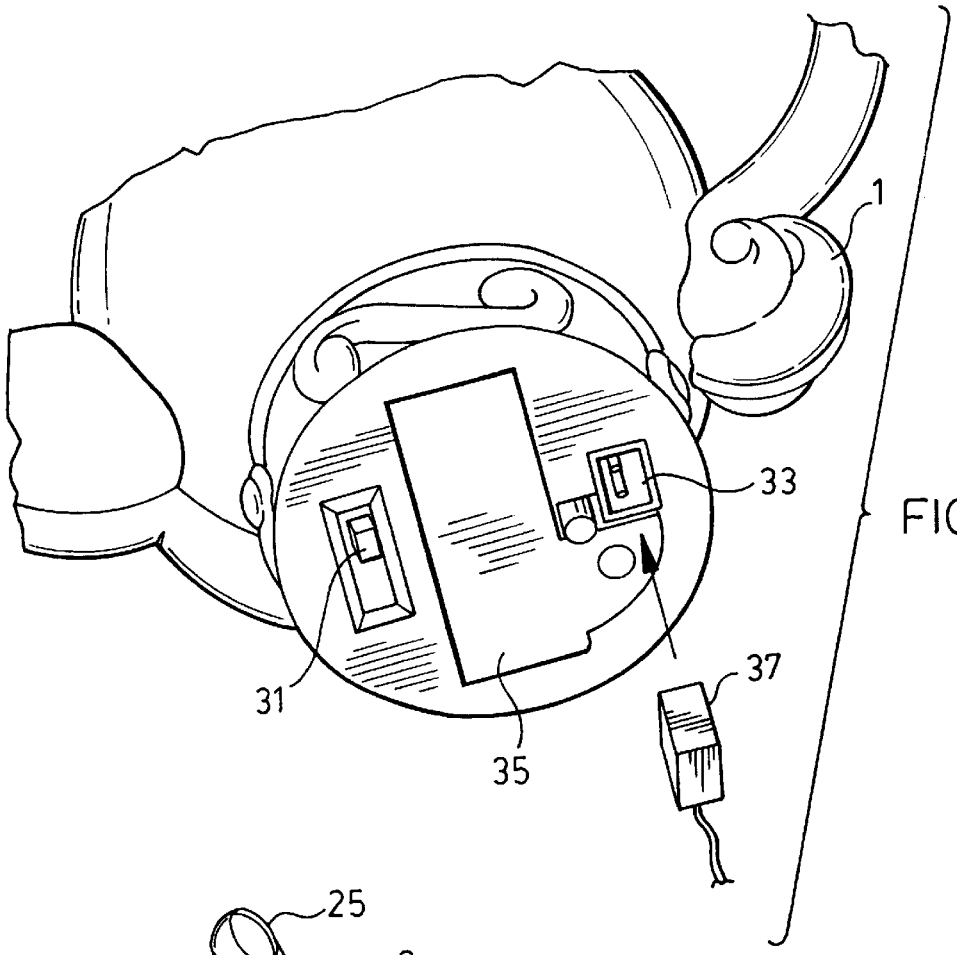
FIG. 4 is a perspective underside view of a teapot showing electrical switches and connections.
Figure 5A:
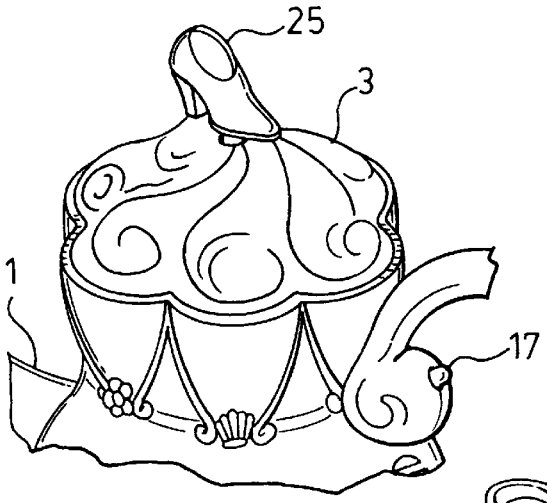
FIGS. 5A and 5B are partial, perspective views of assembled teapots with different lids assembled and operational.
Figure 5B:
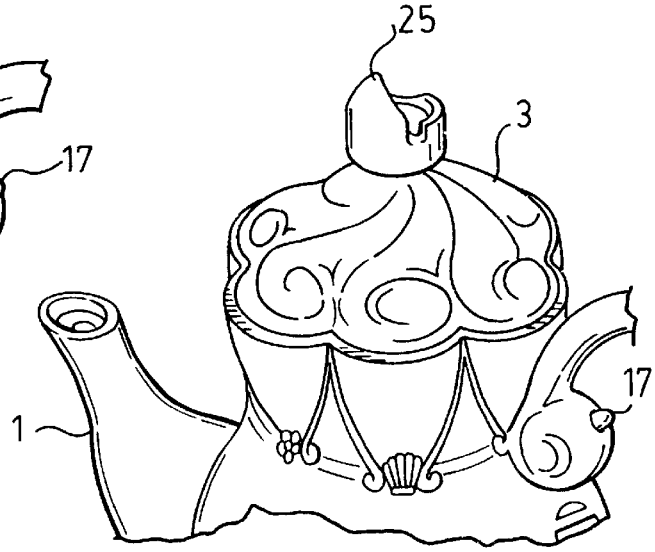
Figure 7A:
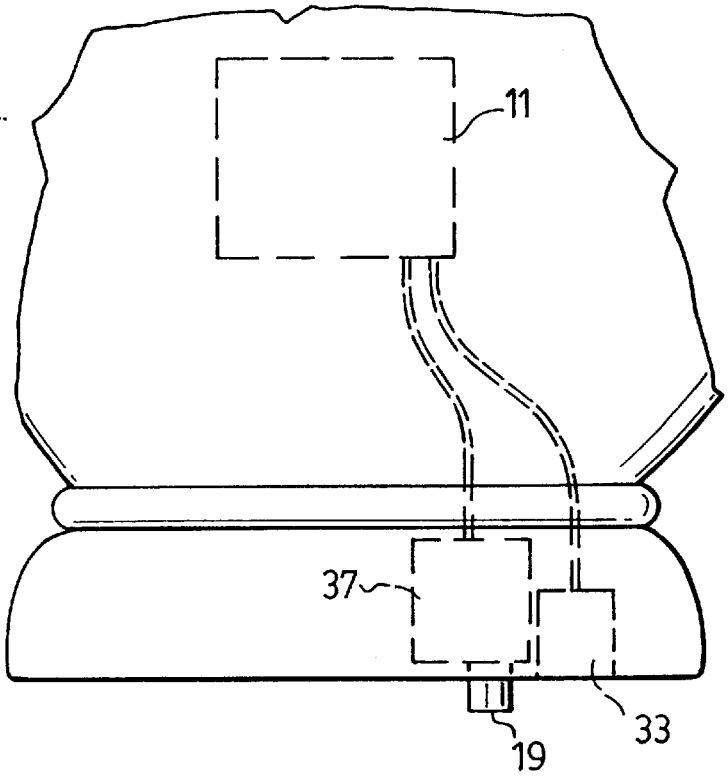
FIGS. 7A and 7B are elevation, cross-sectional, schematic views of the teapot with status switch means in open and closed positions.
Figure 7B:
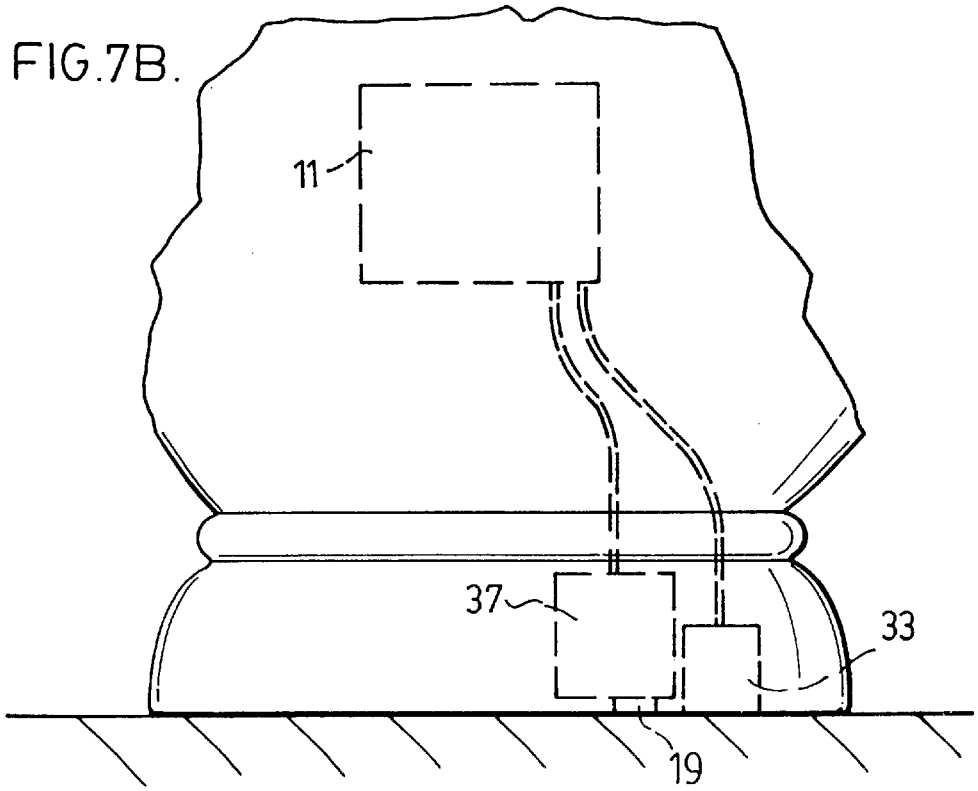

Referring to FIG. 4, the toy teapot is adapted for use in its packaging prior to sale, or outside of its packaging after sale. Switch 31 places the toy in a "try me" mode for use in-store, an "off" position when the toy is intended not to be in use for a lengthy period of time, or into a "play" position so that the toy can be used when removed from its packaging. Receptacle 33 is adapted to receive electrical connector 37 for in-store use when the switch 31 is in the "try me" position. Cover 35 may be removed to allow replacement of electrical storage batteries 37 (illustrated in FIGS. 7A and 7B).

Figure 6:
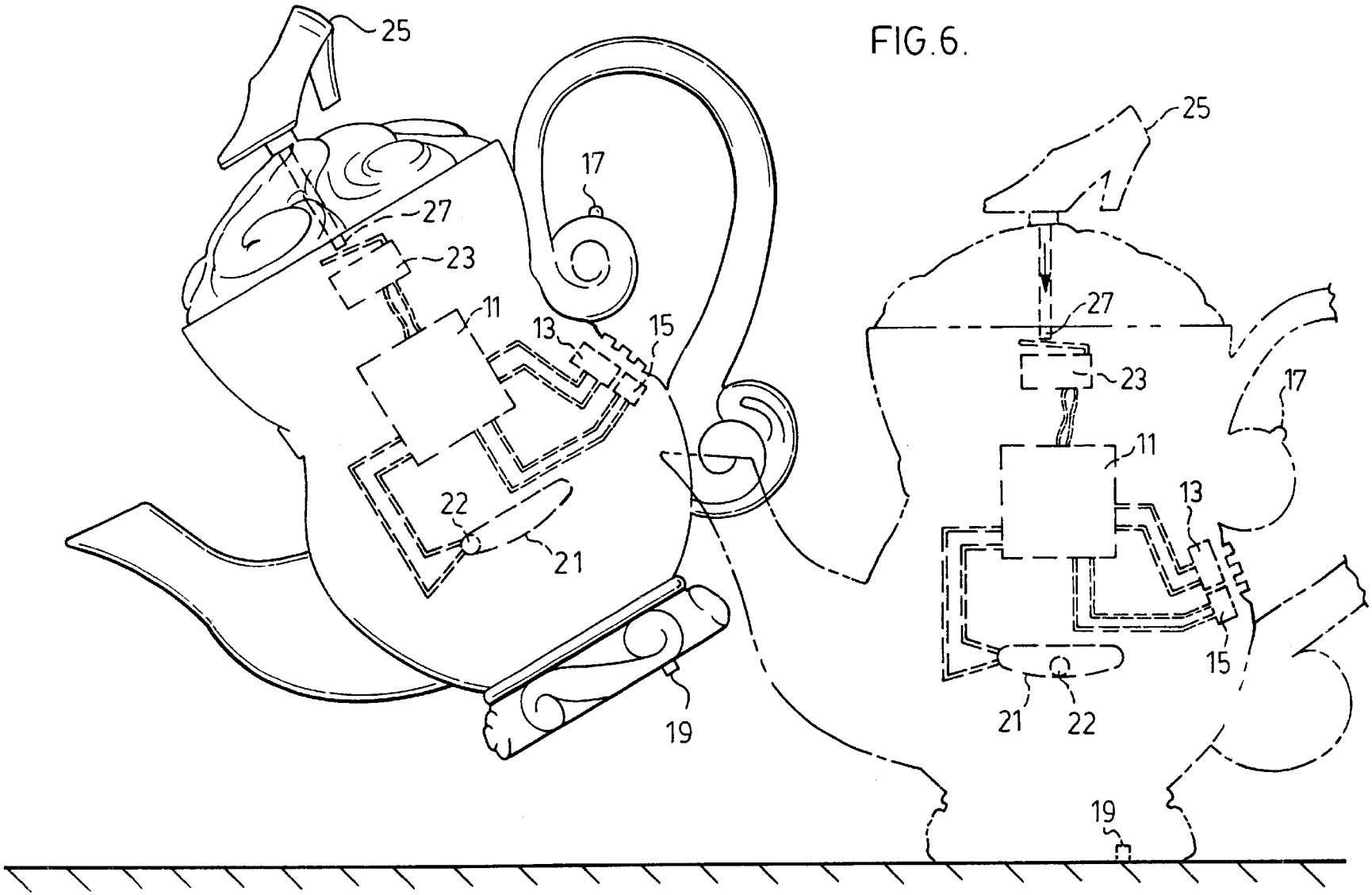
FIG. 6 is an elevation, cross-sectional, schematic view of a teapot in the resting and pouring positions.

When a lid 3 is placed on the pot 1, and protrusion 27 enters orifice 29, the toy is in a pre-operational mode. By depressing trigger means 25, protrusion 27 contacts trigger switch 23 as illustrated in FIG. 6. This allows electrical power to flow and operation of the toy to begin.

Still referring to FIG. 6, activation of trigger switch 23 provides power to the microprocessor 11 which controls the electronic operation of the toy. When the trigger switch is activated, the microprocessor, using pre-recorded human speech, sound effects, or music, generates sounds through speaker 13. After a sound sequence is generated, the toy pauses and indicator light 17 is illuminated. This prompts the user to respond to the personality speaking from the teapot. As long as responses are generated by the user, the teapot will continue to generate further sound segments under control of the microprocessor 11. The voice of the user is detected by microphone 15 and signals are directed to microprocessor 11 through electrical connections.

Still referring to FIG. 6, in the right hand drawing, the teapot is resting on a flat surface. Status switch 19 is pressed upwards against a biased spring and the status of the toy is detected by microprocessor 11 in order that appropriate sound segments may be generated. When the teapot is lifted from the flat surface, status switch 19 is returned to its relaxed position under pressure from the spring and the changed status is relayed to the microprocessor 11. The microprocessor 11 then generates sound segments appropriate to initiation of tea pouring, actual tea pouring, and completion of tea pouring. Tilt switch 21 comprising a metal ball 22 which rolls from a resting position to a contact position when the teapot is tilted, serves to signal the degree of tilting to the microprocessor. As long as the teapot is tilted, the sound of pouring tea may be generated at speaker 13. After a suitable length of time, the sound of the teapot running dry can be created. This will prompt the user to place the teapot down so that the status switch 19 can be reset. Then, further tea pouring can commence.

A timer (not shown) may be incorporated into the electronics of the teapot so that after the teapot sits for a period of time, the electrical connection will be terminated to save battery power in a manner known in the art. In order to reactivate the teapot, the trigger means may be depressed again to reactivate the trigger switch.

Although a preferred embodiment of the invention has been illustrated, it will be apparent to persons skilled in the art that modifications to the preferred embodiment may be made without departing from the spirit and scope of the invention.

What is claimed is:

1. A toy comprises: a first part and a second part, the parts being adapted to be placed into registration, the first part comprising a sensor having a predetermined range, the second part comprising one or more reflective areas adapted to be sensed and one or more non-reflective areas adapted not to be detected by the sensor, such that when the second part is placed into registration with the first part, a sensor signal is generated specific to the area or areas sensed; and processing means in the first part adapted to receive said signal and to generate an appropriate response; wherein non-reflective areas comprise recessed surfaces adapted to lie outside the predetermined range of the sensor when the first and second part are placed into registration.

2. The toy of claim 1, further comprising a multiplicity of second parts coded by reflective and non-reflective areas to be individually recognized by the first part when placed into registration.

3. The toy of claim 1, further comprising multiple sensors.

4. The toy of claim 2, further comprising multiple sensors.

5. The toy of claim 2, wherein the reflective areas comprise surfaces adapted to lie within the predetermined range of the sensor.

6. The toy of claim 3, wherein the reflective areas comprise surfaces adapted to lie within the predetermined range of the sensors.

7. The toy of claim 4, wherein reflective areas comprise surfaces adapted to lie within the predetermined range of the sensors.

8. An electronic toy teapot comprising a pot and a plurality of lids:

each lid corresponding to a particular character or personality;

sensor means in the pot adapted to detect which of said lids is located on the part at any time;

processing means to receive a signal from the sensor means and to generate an appropriate response corresponding to the particular lid located on the pot;

communication means to express said response audibly or visually; and a microphone acting with said processing means to receive an audible signal from a user of the teapot, and to generate the audible or visual response within a suitable delay thereafter.

9. The electronic toy teapot of claim 8, wherein the audible or visual response comprises one or more of voice effects, sound effects, and music.

10. The electronic toy teapot of claim 9, further comprising an indicator light to indicate to the user that an audible signal is desired or anticipated.

11. The electronic toy teapot of claim 8, further comprising status switch means adapted to change between open and closed conditions as the teapot is lifted in readiness for simulated pouring, or set down after pouring.

12. The electronic toy teapot of claim 8, further comprising tilt switch means adapted to initiate the sound of pouring tea when the teapot is tilted to lower the spout, and to end said tea-pouring sound when the teapot is returned to a substantially upright position.

13. The electronic toy teapot of claim 8, further comprising trigger means to initiate delivery of electrical power from a battery power source to the electronic components of the teapot.

14. The electronic toy teapot of claim 13 wherein said trigger means are located on each lid.

15. The electronic toy teapot of claim 14, wherein said trigger means comprise a protrusion on each lid adapted to trigger a trigger switch located on or in the pot.

16. The electronic toy teapot of claim 9, further comprising:

an indicator light to indicate to the user that an audible signal from the user is desired or anticipated;

status switch means adapted to change between open and closed conditions as the teapot is lifted in readiness for simulated pouring or set down after pouring;

tilt switch means adapted to initiate the sound of pouring tea when the teapot is tilted to lower the spout, and to end said tea pouring sound when the teapot is returned to a substantially upright orientation; and trigger means comprising a protrusion on each lid adapted to trigger a trigger switch on the pot to initiate delivery of electrical power from a storage battery to the electronic components of the teapot.

* * * * *